US009215909B2

(12) United States Patent
Saccullo et al.

(10) Patent No.: US 9,215,909 B2
(45) Date of Patent: Dec. 22, 2015

(54) FOOTWEAR WITH INTERCHANGEABLE HEEL COMPONENTS

(71) Applicants: Sandra L. Saccullo, New York, NY (US); Mark Dimuzio, New York, NY (US); Andrew Serbinski, Annandale, NJ (US); Richard Wyant, Phillipsburg, NJ (US); Eric Leal, Winston-Salem, NC (US)

(72) Inventors: Sandra L. Saccullo, New York, NY (US); Mark Dimuzio, New York, NY (US); Andrew Serbinski, Annandale, NJ (US); Richard Wyant, Phillipsburg, NJ (US); Eric Leal, Winston-Salem, NC (US)

( * ) Notice: Subject to any disclaimer, the term of this patent is extended or adjusted under 35 U.S.C. 154(b) by 365 days.

(21) Appl. No.: 13/694,306

(22) Filed: Nov. 16, 2012

(65) Prior Publication Data

US 2014/0137436 A1 May 22, 2014

(51) Int. Cl.

| | |
|---|---|
| ***A43B 13/28*** | (2006.01) |
| ***A43B 21/24*** | (2006.01) |
| ***A43B 3/24*** | (2006.01) |
| ***A43B 21/42*** | (2006.01) |
| ***A43B 13/36*** | (2006.01) |

(52) U.S. Cl.

CPC ..... *A43B 21/24* (2013.01); *A43B 3/246* (2013.01); *A43B 13/36* (2013.01); *A43B 21/42* (2013.01)

(58) Field of Classification Search

CPC ..... A43B 3/24; A43B 13/36; A43B 3/242; A43B 3/244; A43B 3/246; A43B 21/36; A43B 21/52

USPC ..... 36/100, 101, 23, 42, 15, 36 R

See application file for complete search history.

(56) References Cited

U.S. PATENT DOCUMENTS

| | | | | |
|---|---|---|---|---|
| 2,478,264 | A | 8/1949 | George et al. | |
| 2,809,449 | A * | 10/1957 | Smith | A43B 3/24 36/101 |
| 4,219,946 | A | 9/1980 | Baum | |
| 4,586,209 | A * | 5/1986 | Bensley | A43D 25/06 12/142 D |
| 4,974,344 | A * | 12/1990 | Ching | 36/101 |
| 5,133,138 | A | 7/1992 | Durcho | |
| 6,023,858 | A | 2/2000 | Srourian | |
| 6,598,318 | B2 * | 7/2003 | Rouben | A43B 13/36 36/117.4 |
| 6,813,847 | B2 * | 11/2004 | Workman | 36/15 |
| 7,028,420 | B2 * | 4/2006 | Tonkel | 36/100 |
| 7,185,448 | B2 | 3/2007 | Schupbach | |
| 7,698,834 | B1 * | 4/2010 | Courville | 36/15 |
| 8,112,908 | B2 | 2/2012 | Visser | |
| 8,307,571 | B1 * | 11/2012 | Ceylan | A43B 3/246 36/101 |
| 2002/0174569 | A1 * | 11/2002 | Tsai | A43B 3/103 36/101 |
| 2004/0187346 | A1 * | 9/2004 | Bianchi et al. | 36/11.5 |
| 2005/0229435 | A1 * | 10/2005 | Shih | 36/101 |
| 2007/0256330 | A1 * | 11/2007 | Wallin et al. | 36/102 |
| 2008/0271343 | A1 * | 11/2008 | Ordenes Haag | A43B 3/24 36/101 |
| 2010/0101113 | A1 * | 4/2010 | Paik | 36/100 |
| 2010/0139123 | A1 * | 6/2010 | Alan et al. | 36/100 |
| 2010/0313446 | A1 * | 12/2010 | Weixelbaumer | A43B 3/128 36/101 |
| 2011/0119954 | A1 | 5/2011 | Ortiz | |

* cited by examiner

*Primary Examiner* — Khoa Huynh
*Assistant Examiner* — Carolyn W Davis
(74) *Attorney, Agent, or Firm* — John C. Laurence; David D. Rodrigues

(57) ABSTRACT

Footwear having interchangeable heels, includes: (a) a top component having a back section, a middle, a front and an upper section for encompassing a foot, the top component having an underside shape and contour, and having at least two separate connect mechanisms for connection to a bottom component; (b) a bottom component having a having back, a middle, and a front section, the bottom component having a topside shape and contour sufficiently coinciding with the top component underside shape and contour so as to nest with one another, and having at least two separate connect mechanisms corresponding to the at least two separate mechanisms of the top component for connection to it; and (c) at least one locking mechanism.

11 Claims, 9 Drawing Sheets

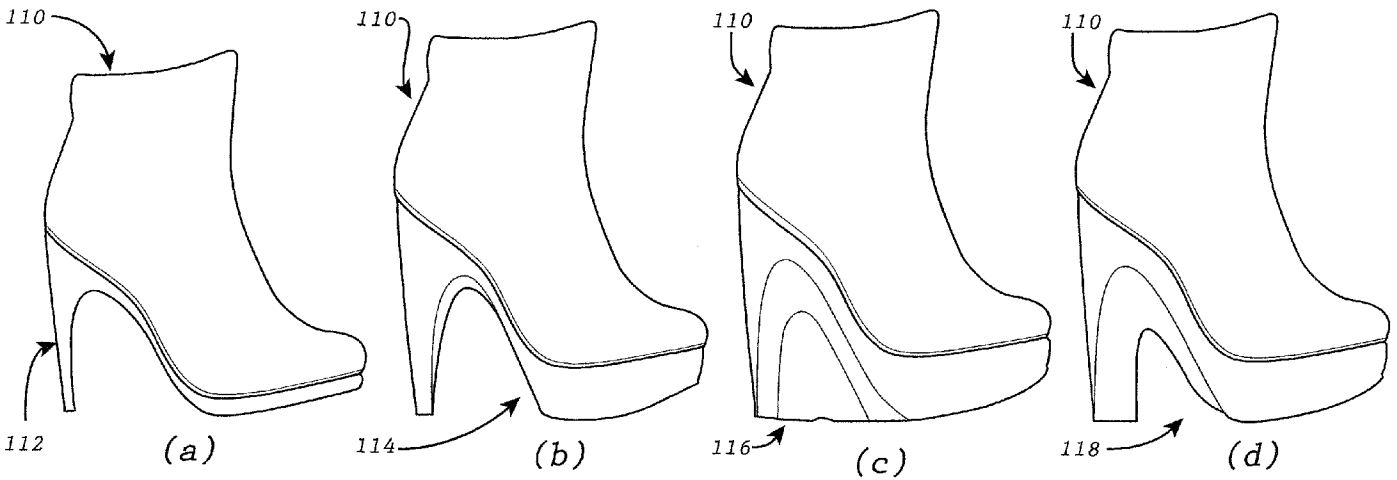
Figures 11 (a) through (d)
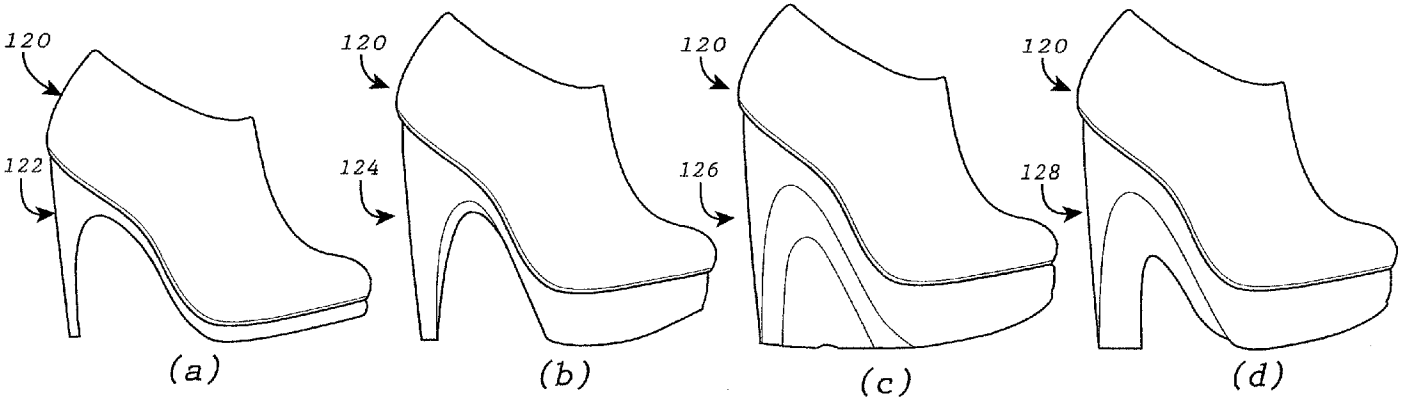
Figures 12 (a) through (d)

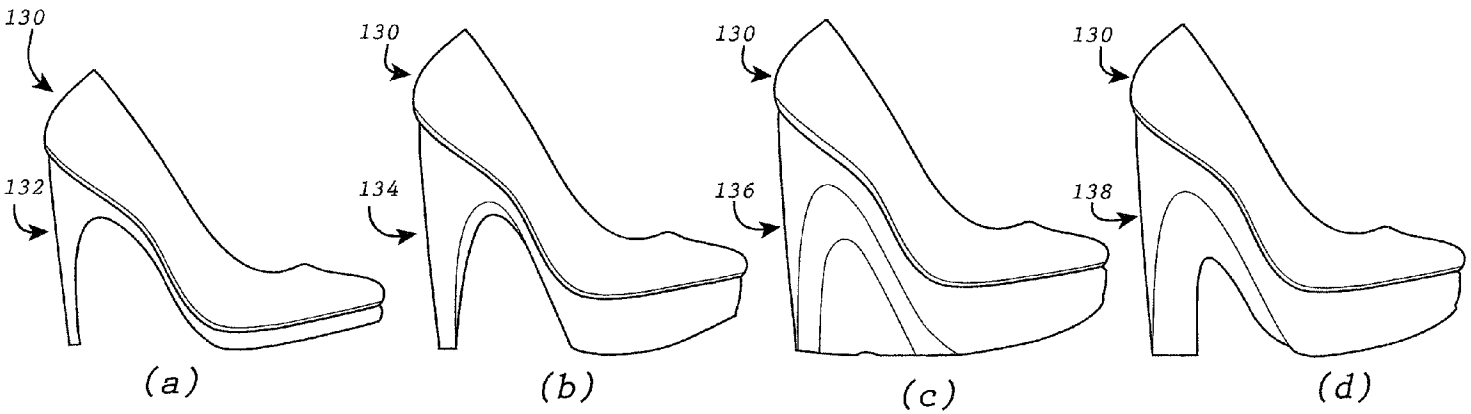
Figures 13 (a) through (d)
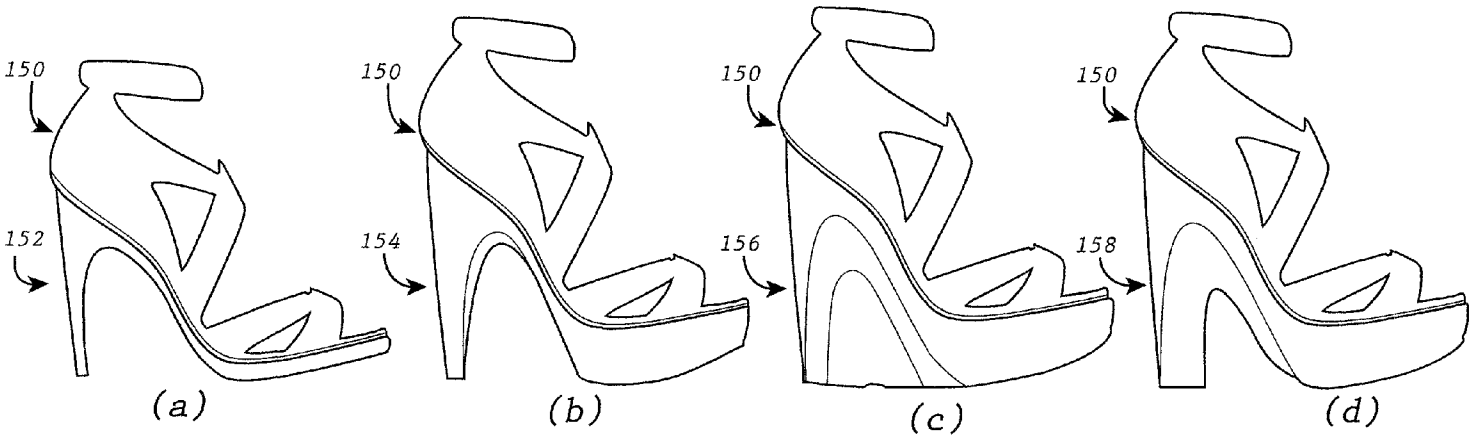
Figures 14 (a) through (d)

FOOTWEAR WITH INTERCHANGEABLE HEEL COMPONENTS

REFERENCE TO RELATED APPLICATION(S)

The present application is based on and claims priority of a previously filed Provisional Patent Application, filed on Sep. 17, 2012, entitled "FOOTWEAR WITH INTERCHANGEABLE HEELS", Ser. No. 61/744,028 by inventors herein.

BACKGROUND OF INVENTION a. Field of Invention

The invention relates generally to footwear, including, but not limited to, shoes, boots and open footwear. More specifically, it involves footwear with interchangeable heels that utilize full length or near full length bottom (heel) components and have unique connect and disconnect mechanisms. These footwear products will provide compatible designs and colors for many different styles of heels and will enable a user to interchange three, four or more different heel bottom components with a single top component and, vice versa, to use a single heel bottom component with many different top components.

b. Description of Related Art

The following patents and applications are representative of various types of footwear with interchangeable components:

U.S. Pat. No. 8,112,908 B2 to Visser describes a shoe with a removable and interchangeable heel that includes a first fixed heel disposed on a heel bottom portion of the shoe. The fixed heel includes a first fastener disposed therein. A second removable and interchangeable heel has a cooperating second fastener disposed therein that is engageable with the first fastener to secure the removable heel to the fixed heel, thereby increasing the effective height of the heel of the shoe.

U.S. Pat. No. 7,185,448 B2 to Schupbach describes a shoe that includes a sole member, at least one heel member, a front securing member, and optionally a forward tread member. Each heel member includes a column portion having a predetermined height and a blade portion having a predetermined slope. Each blade portion's slope corresponds to the respective column portion's height for providing a proper amount of arch support for a user's foot. The sole member has an arch region made of a flexible material that defines a sleeve for selectively receiving each respective blade portion. Each blade portion includes a flange extending longitudinally therealong, and the sleeve defines a complementary groove. When the sleeve receives a respective blade portion, the blade portion provides shape and structural support for the sole member. Means for releasably attaching the respective column portion to the sole member are utilized, and the front securing member may secure the sole member to the user's foot.

U.S. Pat. No. 6,023,858 to Srourian describes a two-piece shoe bottom system including a platform structure and a hollow interchangeable heel structure. The platform structure comprises a lower forepart portion, a raised rear heel portion, and a middle wedge portion connecting the forepart portion to the raised rear heel portion. The raised rear heel portion is elevated substantially above the forepart portion so that it will correspond to a particular height of the interchangeable heel structure. A reinforcing bolt member is molded to the underside of the raised heel portion of the platform structure. The hollow interchangeable heel structure is detachably attached to the reinforcing bolt member.

U.S. Pat. No. 5,133,138 to Durcho describes a replaceable high heel for use with a shoe having an upper and a sole and with a block downwardly extending from the lower portion of the sole adjacent to the heel and with a magnetic plate facing downwardly from the block, an improved replaceable heel having an upper surface with an upwardly facing recess therein and a magnetically responsive plate face upwardly on the lower surface of the recess.

U.S. Pat. No. 4,219,946 to Baum describes a shoe with an interchangeable heel that comprises two parts, a main sole part reinforced in its rear end section by a rigid plate and a separate heel part. The heel part is fitted to the reinforced section of the sole part by a ferrule, fixed to one part, having a projecting portion of non-circular cross-section which locates in an aperture of complementary shape in the other part so as to position and prevent rotation of the heel, and a removable locking element is provided to lock the heel part in place.

U.S. Pat. No. 2,478,264 to George et al describes an interchangeable heel and heel tap arrangement with an attaching plate on the bottom of a shoe for attachment and removal of a heel that utilizes a resilient latch.

United States Patent Application No. 2011/0119954 to Ortiz describes a safety replaceable heel mechanism that is used to adjust the height of women's shoes. The mechanism comprises a shoe sole, a removable heel comprising a heel connector and a interchangeable heel, and a locking key to securely connect the removable heel to the shoe sole. The heel is detached and the shoe can be worn without the heel, providing a pair of shoes suitable for different occasions. The invention is provides a stable structure avoiding unwanted movement of the removable heel for adjusting the comfort of a particular pair of shoes during the course of a day.

Notwithstanding the prior art, the present invention is neither taught nor rendered obvious thereby.

SUMMARY OF INVENTION

The present invention is directed to a footwear having interchangeable heels. It includes: (a) a top component having a having back section, being a heel pad section, a middle section, being an arch section, and a front section, being a toe section, and having an upper section for encompassing a foot, each of the front section, middle section, back section and upper section being connected to one another, the top component having an underside shape and contour, and the top component having at least two separate connect mechanisms for connection to a bottom component; (b) a bottom component having a having back section, being a heel section, a middle section, being an arch section, and a front section, being a toe section, each of the front section, middle section and back section being connected to one another, the bottom component having an topside shape and contour sufficiently coinciding with the top component underside shape and contour so as to nest with one another, the bottom component having at least two separate connect mechanisms corresponding to and in cooperation with the at least two separate mechanisms of the top component for connection to the top component; and, (c) at least one locking mechanism having a lock position and an unlock position, wherein, when the top component and the bottom component are connected to one another with the connect mechanisms and the locking mechanism is in the lock position, the top component and the bottom component cannot be separated from one another, and, when the locking mechanism is then moved to its unlock position, the top component and the bottom component can be separated from one another for component interchangeability.

In some preferred embodiments of the present invention footwear having interchangeable heel components, there are three separate connect mechanisms on each of the top component and the bottom component that are complementary to one another.

In some preferred embodiments of the present invention footwear having interchangeable heel components, the connect mechanisms are selected from the group consisting of latches, clasps, clamps, snaps and sliders.

In some preferred embodiments of the present invention footwear having interchangeable heel components, the connect mechanisms are selected from the group consisting of tracks, heads and slots, hooks and loops, and spring levers.

In some preferred embodiments of the present invention footwear having interchangeable heel components, the connect mechanisms are selected from the group consisting of ball and recess mechanisms and twist and lock mechanisms.

In some preferred embodiments of the present invention footwear having interchangeable heel components the footwear is selected from the group consisting of boots, high heel dress shoe, casual high heels, pumps and ankle booties.

In some preferred embodiments of the present invention footwear having interchangeable heel components, the bottom component has a heel selected from the group consisting of stiletto, platform, pump, chunky and wedge.

In some preferred embodiments of the present invention footwear having interchangeable heel components, the footwear is made of material selected from the group consisting of sheet, woven, synthetic and combinations thereof.

In some preferred embodiments of the present invention footwear having interchangeable heel components, the footwear is a set comprising one pair of top components and at least two pairs of bottom components.

In some preferred embodiments of the present invention footwear having interchangeable heel components, the footwear is a set comprising one pair of top components and four pairs of bottom components.

In some preferred embodiments of the present invention footwear having interchangeable heel components, there is a single locking mechanism having a lock position and an unlock position, wherein, when the top component and the bottom component are connected to one another with the connect mechanisms and the locking mechanism is in the lock position, all of the connect mechanisms cannot be separated and the top component and the bottom component cannot be separated from one another, and, when the locking mechanism is then moved to its unlock position, all of the connect mechanisms can be separated from one another and the top component and the bottom component can be separated from one another for component interchangeability.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings:

FIGS. 11(*a*), 11(*b*), 11(*c*), and 11(*d*) show one example of a present invention footwear set with one top component and four different interchangeable bottom components;

FIGS. 12(*a*), 12(*b*), 12(*c*), and 12(*d*) show a second example of a present invention footwear set with one top component and four different interchangeable bottom components;

FIGS. 13(*a*), 13(*b*), 13(*c*), and 13(*d*) show a third example of a present invention footwear set with one top component and four different interchangeable bottom components;

FIGS. 14(*a*), 14(*b*), 14(*c*), and 14(*d*) show a forth example of a present invention footwear set with one top component and four different interchangeable bottom components:

DETAILED DESCRIPTION OF THE EMBODIMENTS

Figure 1:
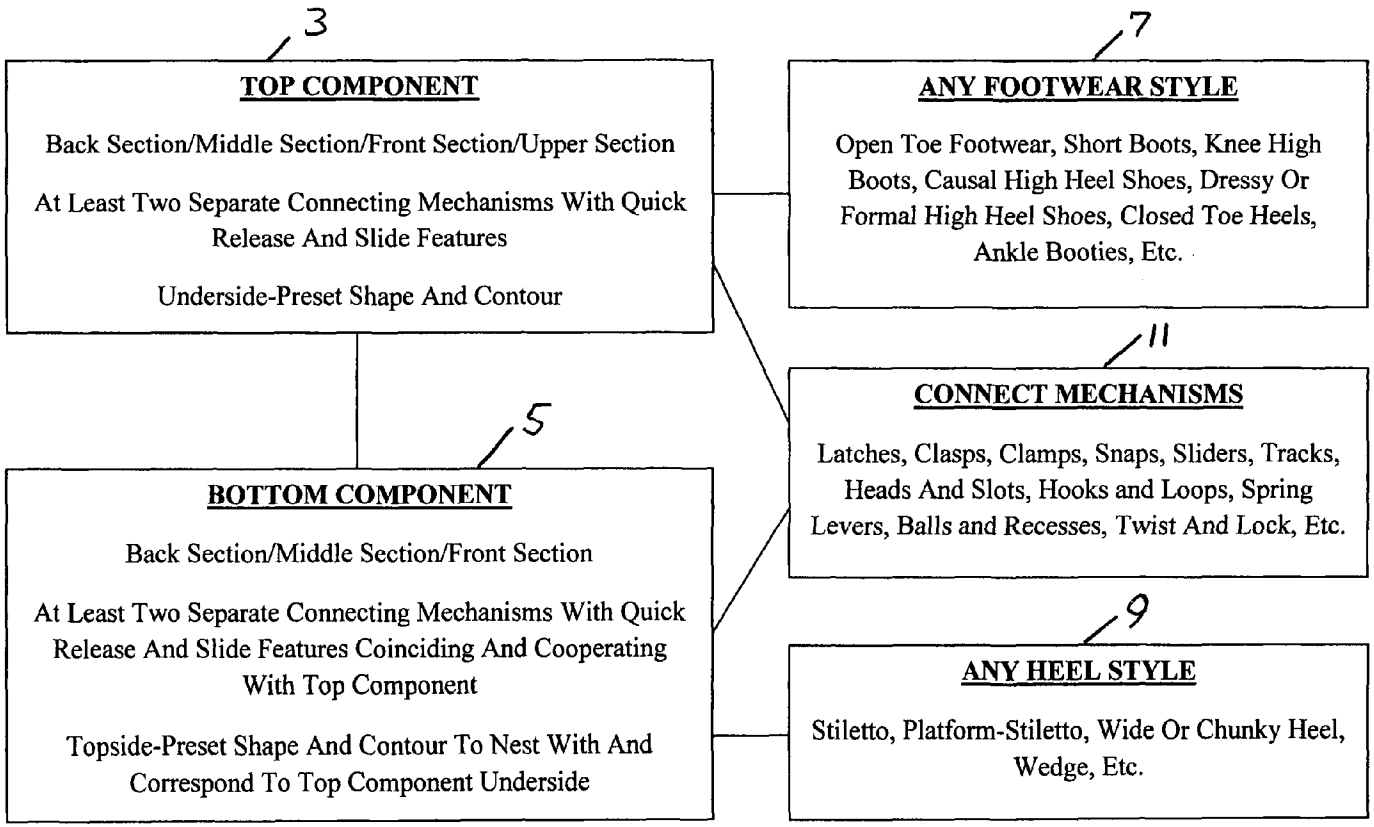
FIG. 1 is a block diagram of various embodiments of the present invention footwear having interchangeable heels.

The present invention enables wearers to effectively have dozens of different footwear designs while reducing costs by providing interchangeable heels. Unlike previous interchangeable heels, the present invention utilizes full length bottom components that have the shape and contour of the top components and both nest with each other and connect to each other in a lockable/unlockable fashion that renders them coincidental and immoveable relative to one another when locked, and interchangeable when unlocked.

For example, a top component, sometimes referred to herein as the "shoe", may be sold as a single pair with multiple interchangeable sets of bottom components, sometimes referred to herein as "the heel". With this unique footwear product, a platform shoe may be readily converted to a wedge, which may readily be converted to a stiletto or a pump or a flat. By collecting multiple pairs of shoes and heels, an incredible array of possible combinations emerge. For example, if one were to purchase two pairs of shoes with three sets of heels each, twelve possible combinations are available. With only three sets of shoes, each having three sets of heels, there are more than twenty five possibilities!

The sets may be year around or seasonal, such as Spring/Summer or Fall or Fall/Winter collections and may be any type of footwear, included but not limited to open toe footwear, short boots, knee high boots, causal high heel shoes, dressy or formal high heel shoes, closed toe heels, ankle bootie, etc. They may come in various colors and textures and may be made of woven, sheet or other material and may be natural or synthetic or a combination of both. In some embodiments there will he two, three, four, five or more heels for each shoe pair. Ideally, a pair of shoes will have three or four sets of different heels, e.g., stiletto, platform-stiletto, wide or chunky heel and wedge.

Each of the heels in a set may preferably match the shoe it is packaged with. For example, as part of the Fall/Winter collection, a closed toe nude patent leather shoe will be packaged with a patent leather nude stiletto, platform, chunky heel and wedge. The Fall/Winter collection will also include a black suede ankle bootie that will be packaged with a black suede stiletto, platform, chunky heel and wedge. Consumers can take the black suede wedge from their ankle bootie package and mix it with the closed toe nude patent leather creating an entirely new shoe.

Every time a consumer buys one present invention shoe set with one shoe and four heels, she is getting four different pairs of shoes. If a consumer buys two sets, she is getting sixteen different shoes. If she buys three sets, she can create up to 36 unique looks. In one scenario, a manufacturer may create a collection, e.g., the "Clique Collection". The entire Clique Collection may consist of ten pairs of shoes (top components), each with four sets of heels (bottom components) for each season. If a consumer buys the entire collection she will own over a hundred different combinations of shoes!!

Each season there may also be Collector's Editions available which will include a shoe and four different pairs of complementary heels that are the same type. For example, as part of the Spring/Summer Collection, there may be the option of buying a Collector's Edition Wedge shoe. The nude leather T-strap will come with four wedges—an espadrille wedge, a cork wedge, a wooden wedge and a leather wedge. For women who have enough stilettos but want to add wedges to their wardrobe, this Collector's Edition will be the perfect fit.

FIG. 1 is a block diagram of various embodiments of the present invention footwear having interchangeable heels. Block 3 establishes the important features of the top component and block 5 established the important features of the bottom component. As can be seen in block 3, the top component ("shoe") has a back section, middle section, front section and upper section. There are at least two separate connecting mechanisms with quick release and slide features. The underside of the top component has a preset shape and contour. As described in block 5, the bottom component ("heel") also has a back section, middle section and front section. There are at least two separate connecting mechanisms with quick release and slide features coinciding and cooperating with the top component connecting mechanisms. The topside of the bottom component has a preset shape and contour to nest with and correspond to top component underside. Block 7 shows the various styles of footwear, which includes open toe footwear, short boots, knee high boots, casual high heel shoes, dress or formal high heel shoes, closed toe heels, ankle booties, etc. As seen in block 9, any heel style may be used, for example, stiletto, platform-stiletto, wide or chunky heel, wedge, etc. Finally, block 11 shows various connect mechanisms for removeably connecting the top component and the bottom component such as latches, clasps, clamps, snaps, sliders, tracks, heads and slots, hooks and loops, spring levers, balls and recesses, twist and lock, etc.

Figure 2:
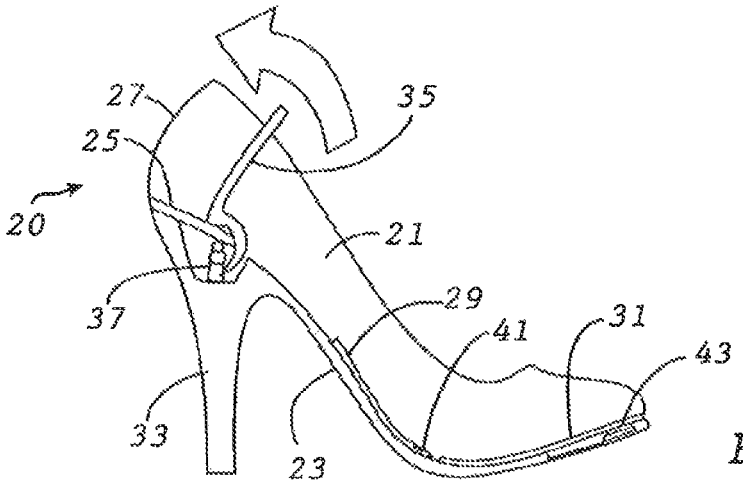
FIG. 2 is a side view of one embodiment of the present invention footwear having interchangeable heels showing a clamp connect mechanism being opened for removal of a top component from a bottom component for interchangeability.

FIG. 2 is a side view of one embodiment of the present invention footwear 20 having interchangeable heels showing a clamp connect mechanism being opened for removal of a top component 21 from a bottom component 23 for interchangeability. Top component 21 has a sole with a back section 25, a middle section 29, and a front section 31, which, respectively, correspond to the heel pad area, the foot arch area and the toe area. There's also an upper member 27 that, in this embodiment, takes the full shape of a shoe with walls and front foot encasement. Bottom component 23 has a full sole and a heel such that the sole has the shape and contour of the top component 21 so that they effectively nest with one another. In this embodiment, there are three connect mechanisms and top components 21 and bottom component 23 that interconnect. Thus, the clamp mechanism and the heel area have receiver 37 and swing latch 35. When latch 35 is lifted upwardly it releases from receiver 37 so that the top component 21 can be lifted away from the bottom component 23. Next, top component 21 is slid back so is to be released from hook 41 and retainer 43 for complete separation.

Figure 3:
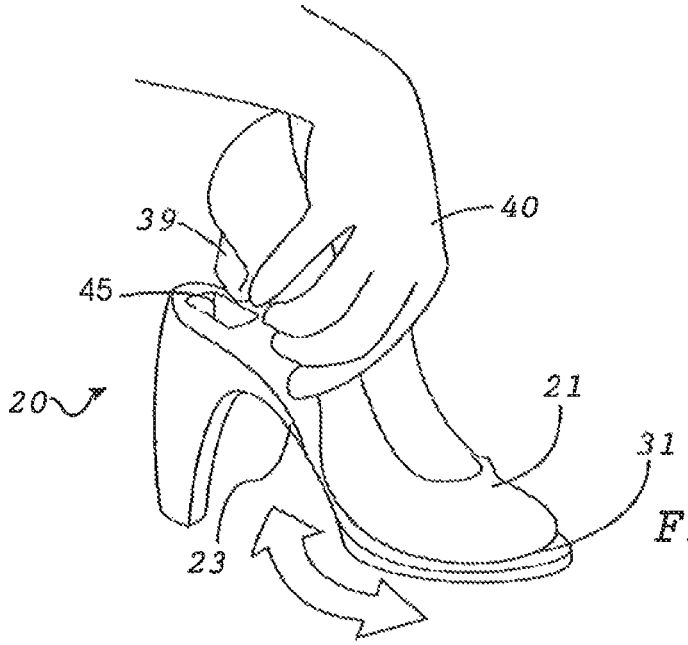
FIG. 3 shows an oblique side view of the present invention footwear shown in FIG. 2, but with the top component partially removed from the bottom component.

FIG. 3 shows an oblique side view of the present invention footwear 20 shown in FIG. 2, but with the top component 21 partially removed from the bottom component 23 as the user is lifting top component 21 with hand 40. Note that in this embodiment, there is a downwardly extending heel block 39 of top component 21 that fits into heel block receiver 45 of bottom component 23. Here, in FIGS. 2, 3 and 4, identical parts are identically numbered and are not all repeated for each of these Figures.

Figure 4:
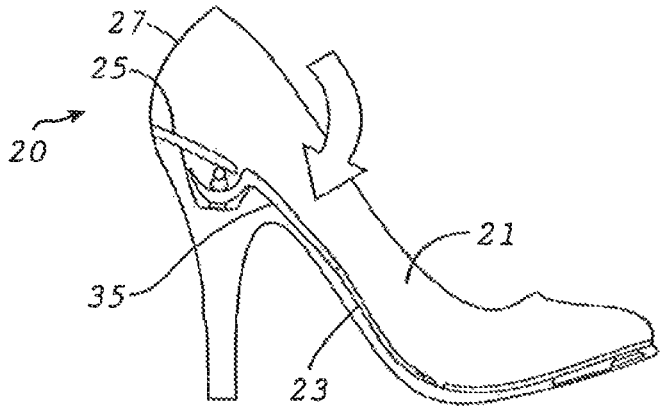
FIG. 4 is a side view of the present invention footwear shown in FIGS. 2 and 3, but wherein the clamp is being closed for attachment of the top component to a bottom component.

FIG. 4 is a side view of the present invention footwear 20 shown in FIGS. 2 and 3, but wherein the clamp 35 is being closed for attachment of the top component 21 to the bottom component 23.

Figure 5:
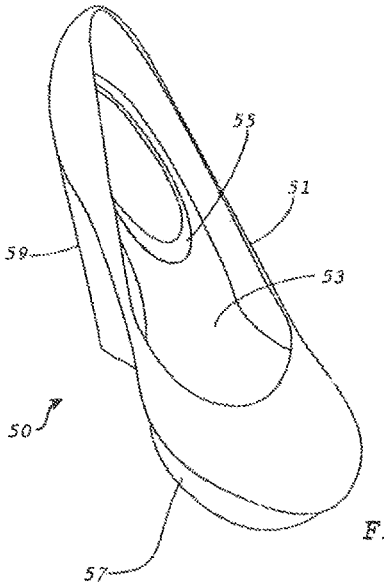
FIGS. 5 and 6 illustrate an example of a present invention footwear latch that is built into the inside sole of the shoe.
Figure 6:
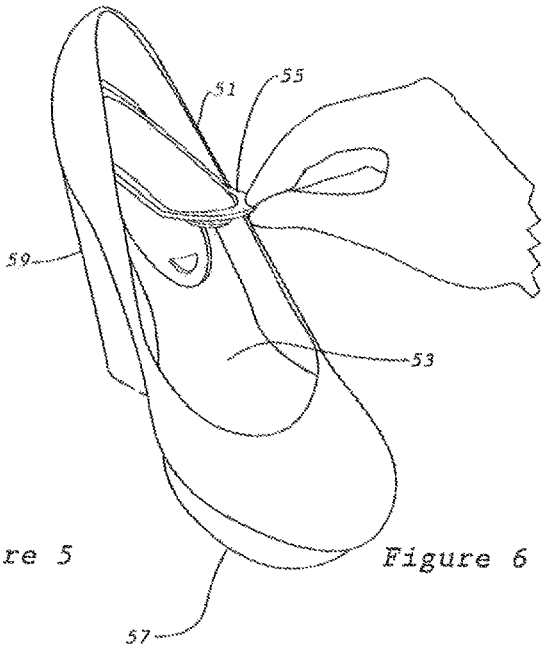
Figure 7:
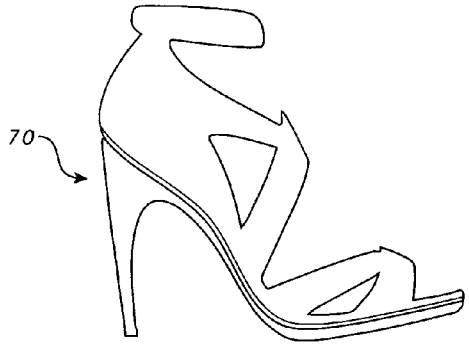
FIGS. 7, 8, 9 and 10 show additional embodiments of present invention footwear.
Figure 8:
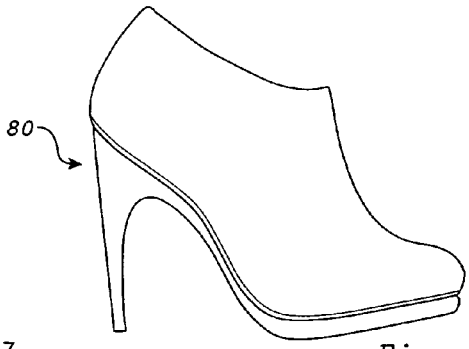
Figure 9:
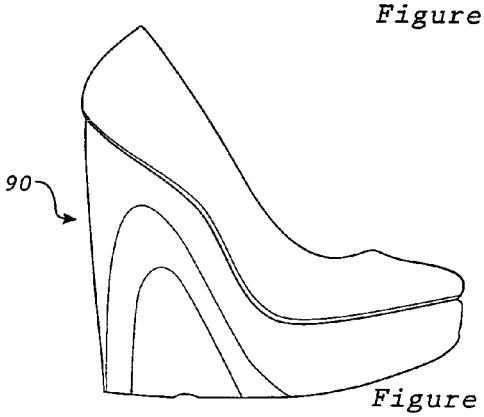
Figure 10:
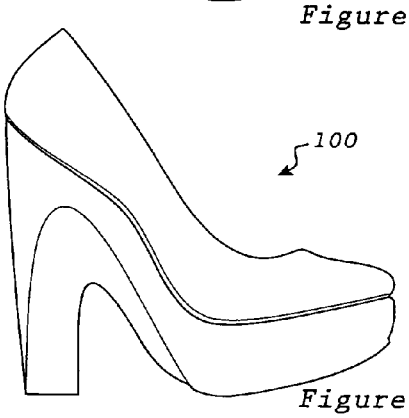

FIGS. 5 and 6 illustrate an example of a present invention footwear latch that is built into the inside sole of the shoe. Here, present invention footwear 50, with top component 51 and bottom component 57 (platform with heel 59) having a back section connect mechanism similar to that shown above in FIGS. 2 through 5, with clasp 55 built into inner sole 53. As shown in FIG. 6 it can be readily lifted as the first step to separating top component 51 from bottom component 57 for interchanging with different top/bottom components.

FIGS. 7, 8, 9 and 10 show additional embodiments of present invention footwear 70, 80, 90 and 100, respectively, and with modem straps and anklet, leather European, patent leather and satin designs, respectively, and with extremely diverse, beautiful, interchangeable bottom components (not numbered).

FIGS. 11(*a*), 11(*b*), 11(*c*), and 11(*d*) show one example of a present invention footwear set with one top component 110 and four different interchangeable bottom components 112, 114, 116 and 118, respectively.

FIGS. 12(*a*), 12(*b*), 12(*c*), and 12(*d*) show a second example of a present invention footwear set with one top component 120 and four different interchangeable bottom components 122, 124, 126 and 128, respectively.

FIGS. 13(*a*), 13(*b*), 13(*c*), and 13(*d*) show a third example of a present invention footwear set with one top component 130 and four different interchangeable bottom components 132, 134, 136 and 138, respectively.

FIGS. 14(*a*), 14(*b*), 14(*c*), and 14(*d*) show a forth example of a present invention footwear set with one top component 150 and four different interchangeable bottom components 152, 154, 156 and 158, respectively.

Figure 15:
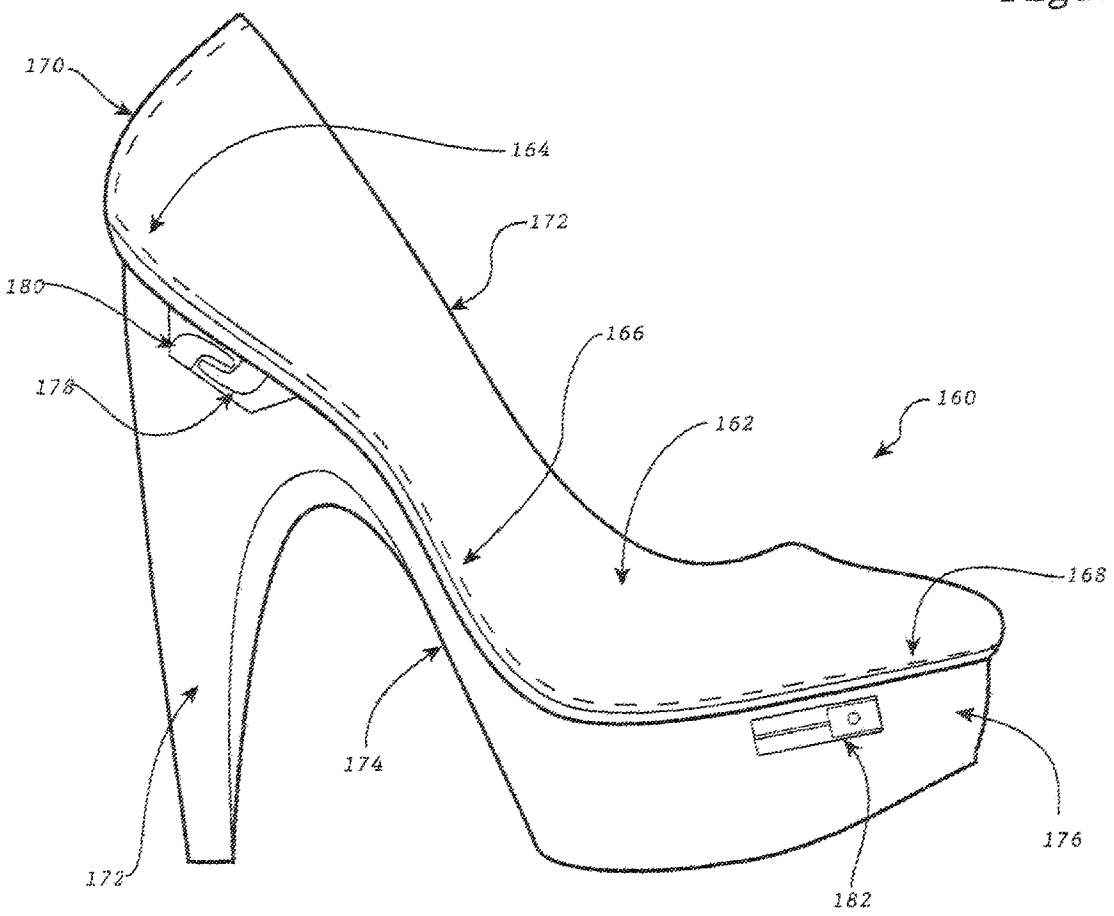
FIG. 15 shows another example of a present invention footwear set with a top component and a bottom component connected with two connect mechanisms with a master lock in the front side position.

FIG. 15 shows another example of present invention footwear set 160 with a top component 162 and a bottom component 174 connected with two connect mechanisms with a single master lock. Top component 162 has a back section 164, a middle section 166, a front section 168 and an upper section 170. The upper section 170 extends the full length of top component 162, in this embodiment, and includes a heel stop, sidewalls and a toe, all for encompassing a foot. It has a predetermined underside contour and shape that corresponds to the topside shape and contour of bottom component 174. Bottom component 174 has a back section 172, a middle section 182, and a front section 176. Back section 172 includes the heel itself.

In FIG. 15, as mentioned above, there are two complete connect mechanisms in this embodiment. There is a connect mechanism pair in the rear, which includes hook 178 on the bottom of top component 162, and hook receiver 180 on the bottom component 174 and a second connect mechanism in the front sections (hidden) and, in the front side position, a spring-biased-closed side lock mechanism 184 connected directly to it. For protection from accidental movement, this lock mechanism 184 may be slightly recessed. When pushed to its open position, lock mechanism 184 releases the front connect mechanism so that top component 162 can then be slid forward (and/or bottom component 174 slid backward) to disconnect both the front and rear connect mechanisms simultaneously. Hence, although lock mechanism 184 is only functionally connected to the front connect mechanism, because it releases both front and rear connect mechanisms, it acts as a single master lock.

Figure 16:
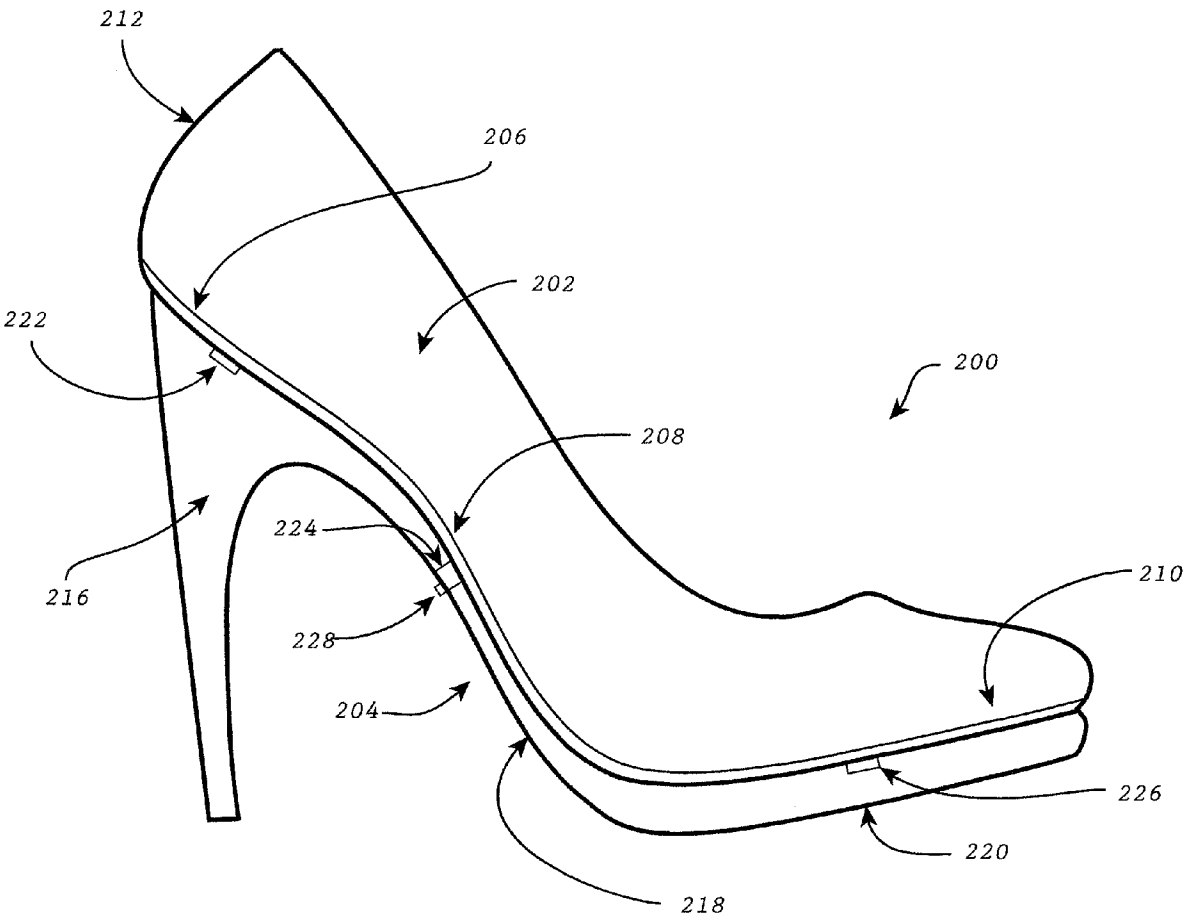
FIG. 16 shows another example of a present invention footwear set with a top component and a bottom component connected with three connect mechanisms with two master locks, in the front side and rear positions; and, FIG. 17 shows a present invent footwear set with a top component and a bottom component connected with three connect mechanisms with one master lock, located on the outside of the upper back of the top component.

FIG. 16 shows yet another example of the present invention footwear set 200 with a top component 202 and a bottom component 204. They are connected with three connect mechanisms with a single master lock in the center bottom. Top component 202 has a back section 206, a middle section 208, a front section 210 and an upper section 212. The upper section 212 extends the full length of top component 202, in the style of a dress heel, commonly known as a high heel shoe. Thus, in this embodiment, an upper section 212 includes a heel stop, sidewalls and a toe, all for encompassing a foot. It has a predetermined underside contour and shape that corresponds to the topside shape and contour of bottom component 204. Bottom component 204 has a back section 216, a middle section 218, and a front section 220. Back section 216 includes the heel itself.

Figure 17:
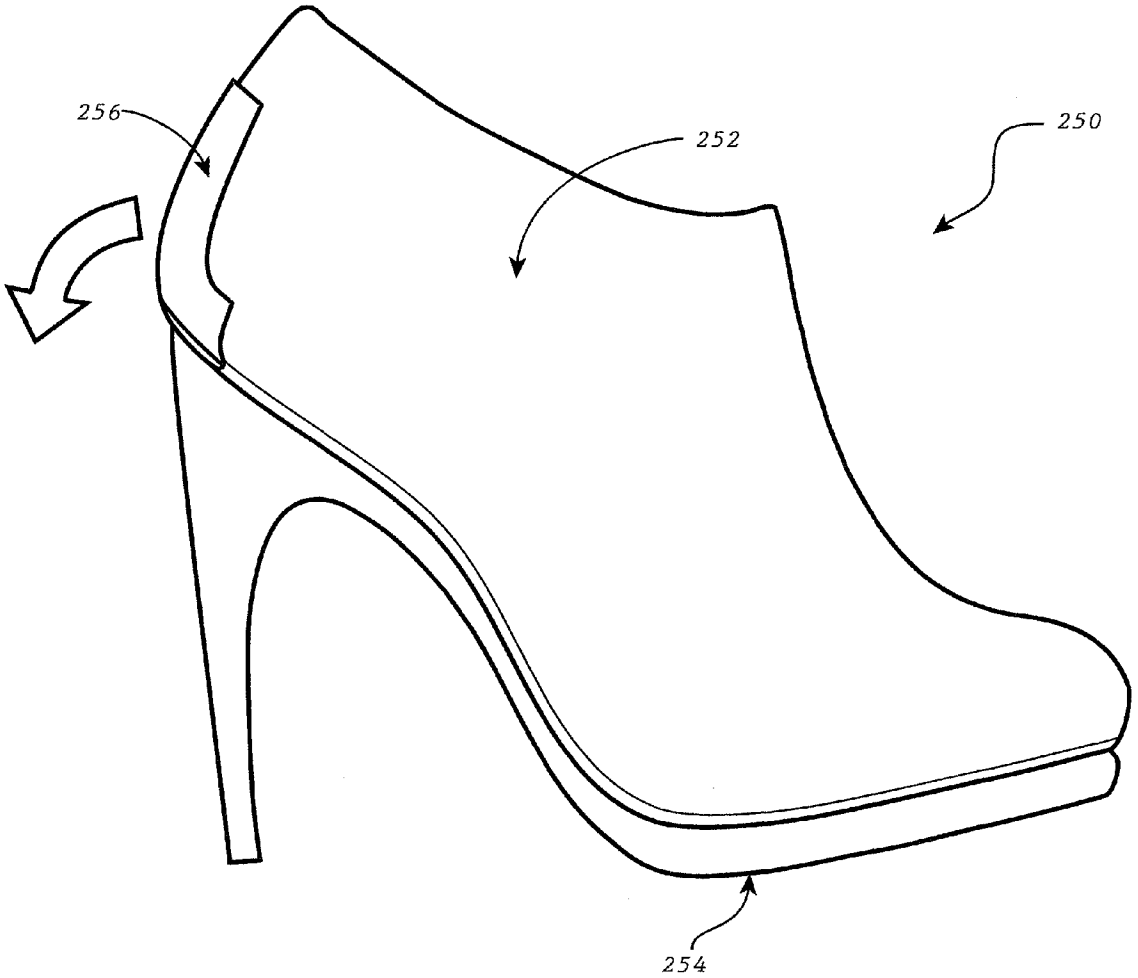

In FIG. 16, as mentioned above, there are three complete connect mechanisms in this embodiment. There is a connect mechanism pair in the rear at block 222, one in the middle at block 224 and one in the front at block 226. They are not shown in detail as they may be any type or combinations of types described in FIG. 1 and elsewhere herein above. Here, there is a single master lock 228, located on the bottom in the center, as shown. This may be a twist or a push or a slide master lock, or any other lock mechanism that is available that will function to release a center connect mechanism, and hence will render all connect mechanisms herein will moveable and disconnectable, when unlocked.

another example of a present invention footwear set with a top component and a bottom component connected with three connect mechanisms with two master locks, in the front side and rear positions; and, FIG. 17 shows a present invent footwear set 250 with a top component 252 and a bottom component 254 connected with three connect mechanisms (hidden, but such as is shown in FIGS. 2 through 4 above, except that the master lock swing lever 256 is on the outside instead of the inside, swings down instead of up to open, and is connected to a bottom component (254) instead of a top component. The lock works similarly to that of the aforementioned FIGS. 2 through 4.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims. For example, in some cases, the lock mechanism and all or part of the connect mechanism may be one and the same piece or they may be different pieces of the shoe.

What is claimed is:

1. Footwear having interchangeable heel components, comprising:

(a) a top component having a back section, being a heel pad section, a middle section, being an arch section, and a front section, being a toe section, and having an upper section for encompassing a foot, each of said front section, middle section, back section and upper section being connected to one another, said top component having an underside with a shape and contour, and said top component having at least two separate connect mechanisms for connection to a bottom component;

(b) the bottom component having a having back section, being a heel section, a middle section, being an arch section, and a front section, being a toe section, each of said front section, middle section and back section being connected to one another, said bottom component having a topside shape and contour sufficiently coinciding with said top component underside shape and contour so as to nest with one another, said bottom component having at least two separate connect mechanisms corresponding to and in cooperation with said at least two separate mechanisms of said top component for connection to said top component; and, (c) a swing latch locking mechanism embedded within the heel pad section of said top component and interfacing with one of the at least two connect mechanisms in the top component, said swing latch locking mechanism having a connection to said top component that provides for said swing latch locking mechanism to rotate about said top component between having a lock position and an unlock position, wherein, when said top component and said bottom component are connected to one another with said connect mechanisms and said swing latch locking mechanism is in said lock position, said top component and said bottom component cannot be separated from one another, and when said swing latch locking mechanism is then rotated to its unlock position, said top component and said bottom component can be separated from one another for component interchangeability.

2. Footwear having interchangeable heel components of claim 1, wherein there are three separate connect mechanisms on each of said top component and said bottom component that are complementary to one another.

3. Footwear having interchangeable heel components of claim 1, wherein said connect mechanisms are selected from the group consisting of ball and recess mechanisms and twist and lock mechanisms.

4. Footwear having interchangeable heel components of claim 1, wherein said footwear is selected from the group consisting of boots, high heel dress shoe, casual high heels, pumps and ankle booties.

5. Footwear having interchangeable heel components of claim 1, wherein said bottom component has a heel selected from the group consisting of stiletto, platform, pump, chunky and wedge.

6. Footwear having interchangeable heel components of claim 1, wherein said footwear is made of material selected from the group consisting of sheet, woven, natural, synthetic and combinations thereof.

7. Footwear having interchangeable heel components of claim 1, wherein said footwear is a set comprising one pair of top components and at least two pairs of bottom components.

8. Footwear having interchangeable heel components of claim 7, wherein said footwear is a set comprising one pair of top components and four pairs of bottom components.

9. Footwear having interchangeable heel components of claim 1, wherein said top component includes at least three separate connect mechanisms, namely at least one connect mechanism in said heel pad section, at least one connect mechanism in said arch section and at least one connect mechanism in said toe section;

wherein said bottom component includes at least three separate connect mechanisms corresponding to and in cooperation with said at least three separate mechanisms of said top component for connection to said top component; and wherein said locking mechanism interfaces with said connect mechanism in said heel pad section of said top component.

10. Footwear having interchangeable heel components of claim 1, wherein said top component includes an upperside with a shape and contour, and wherein said swing latch locking mechanism includes a swing arm and a latch, said swing arm having a shape and contour that coincides with said shape and contour of said upperside of said top component.

11. Footwear having interchangeable heel components of claim 10, wherein said swing arm is nested within said upperside of said top component in said locked position and wherein said swing arm is at an angle relative to said upperside of said top component in said unlocked position.

* * * * *